US006228187B1

(12) United States Patent
Till

(10) Patent No.: US 6,228,187 B1
(45) Date of Patent: May 8, 2001

(54) APPARATUS AND METHODS FOR GENERATING AN ARTIFICIAL ATMOSPHERE FOR THE HEAT TREATING OF MATERIALS

(75) Inventor: Kenneth A. Till, Bend, OR (US)

(73) Assignee: Air Liquide America Corp., Houston, TX (US)

( * ) Notice: Subject to any disclaimer, the term of this patent is extended or adjusted under 35 U.S.C. 154(b) by 0 days.

(21) Appl. No.: 09/136,304

(22) Filed: Aug. 19, 1998

(51) Int. Cl.[7] ..... C22F 1/16
(52) U.S. Cl. ..... 148/559; 148/708; 164/66.1
(58) Field of Search ..... 148/559, 636, 148/708, 712, 713; 423/262; 164/66.1

(56) References Cited

U.S. PATENT DOCUMENTS

| | | | |
|---|---|---|---|
| 3,443,806 | 5/1969 | Galey et al. | 226/34 |
| 3,484,232 | 12/1969 | Karinthi et al. | 75/45 |
| 3,619,172 | 11/1971 | Lutgen et al. | 75/59 |
| 3,640,702 | 2/1972 | Karinthi et al. | 75/59 |
| 3,664,652 | 5/1972 | Spire et al. | 266/34 |
| 3,689,048 | 9/1972 | Foulard et al. | 266/34 |
| 3,743,500 | 7/1973 | Foulard et al. | 75/93 |

(List continued on next page.)

FOREIGN PATENT DOCUMENTS

| | | |
|---|---|---|
| 0 300 907 | 7/1988 | (EP) . |
| 1 624 033 | 1/1991 | (SU) . |
| 1 724 705 | 4/1992 | (SU) . |

OTHER PUBLICATIONS

Fully Computerised Heat–Treatment Centre Provides Massive Controlled Atmosphere Capacity, Metallurgia, Oct. 1997.

Canadian Metallurgical New; Controlled Atmospheres for Heat Treating, Jul. 1984.

Effect of Heat Treatment on the Microstructure of a Metastable β–Titanium Alloy, X. Huang et al., MEPEG (1994) 3:560–566.

1987 Electric Furnace Proceedings, C.T. Jensen, et al., "Atmospheric Protection of Bill Streams Using Carbon Dioxide."

Heat Treating of Titanium and Titanium Alloys, Roger Gilbert et al., ASM Metals Handbook, vol. 4, 1991.

Castexpo '96 and 100$^{th}$ AFS Casting Congress, R.C. Best and Z. Zurecki, "Development of Gas Swirling Method for Inserting Metals in Melting Furnances." Apr. 1996.

Controlled Atmospheres for Thermochemical Surface Engineering, Metallurgia vol. 59, Mar., 1992.

Controlled Atmosphere Treatments, Metallurgia, Aug. 1987, p. 356.

Selection of Gaseous Atmospheres In In Fluidized Bed Furnaces for Controlled Heat–Treatments, Metallurgia, Aug. 1967, pp. 353–355.

(List continued on next page.)

*Primary Examiner*—Roy King
*Assistant Examiner*—Andrew L. Oltmans
(74) *Attorney, Agent, or Firm*—Fulbright & Jaworski, L.L.P.

(57) ABSTRACT

An apparatus and method for generating artificial atmospheres in a furnace for the heat treating of materials. The furnace includes a substantially isolated chamber having a discharge receiving orifice for accepting a bi-phasic cryogen into a hot/work zone of the chamber. A low pressure cryogen source feeds a bi-phasic inert gas into the chamber in order to allow the volumetric expansion of the evaporating liquid constituent of the bi-phasic cryogen to purge a substantial portion of the ambient oxygen from the chamber and to allow a substantial residual concentration of the inert gas to blanket the process area without significant dissipation during the heat treating process. Oxidizable materials heat treated in artificial atmospheres generated by use of bi-phasic cryogens show no signs of scaling or staining through the process and thus do not need to undergo acid bathing prior to subsequent processing.

20 Claims, 4 Drawing Sheets

U.S. PATENT DOCUMENTS

| | | | |
|---|---|---|---|
| 3,868,987 | 3/1975 | Galey et al. | 164/52 |
| 4,059,424 | 11/1977 | Bentz | 62/49 |
| 4,087,899 | 5/1978 | Chevalier et al. | 29/527 |
| 4,093,553 | 6/1978 | Galey et al. | 252/70 |
| 4,178,980 | 12/1979 | Gilbert et al. | 164/66 |
| 4,179,103 | 12/1979 | Bentz et al. | 266/225 |
| 4,181,522 | 1/1980 | Galey et al. . | |
| 4,211,269 | 7/1980 | Bemtz et al. | 164/67 |
| 4,309,214 | 1/1982 | Foulard et al. | 75/0.5 B |
| 4,460,409 | 7/1984 | Devalois et al. | 75/96 |
| 4,480,770 | 11/1984 | Goursat et al. | 222/590 |
| 4,515,645 | 5/1985 | Böhm . | |
| 4,518,421 | 5/1985 | Foulard et al. . | |
| 4,614,216 | 9/1986 | Savard et al. | 164/67 |
| 4,657,587 | 4/1987 | Savard et al. | 75/96 |
| 4,666,511 | 5/1987 | Naud | 75/51.7 |
| 4,723,997 | 2/1988 | Lutgen | 75/96 |
| 4,781,122 | 11/1988 | Foulard et al. | 164/475 |
| 4,805,688 | 2/1989 | Foulard et al. | 164/475 |
| 4,806,156 | 2/1989 | Anderson et al. | 75/96 |
| 4,848,751 | 7/1989 | Lutgen et al. | 266/44 |
| 4,915,362 | 4/1990 | Borasci et al. | 266/266 |
| 4,990,183 | 2/1991 | Anderson et al. | 75/555 |
| 5,190,577 | 3/1993 | Bermel et al. | 75/552 |
| 5,196,072 | 3/1993 | Bermel et al. | 148/194 |
| 5,343,491 | 8/1994 | Herren et al. | 373/8 |
| 5,344,478 | 9/1994 | Zurecki et al. | 75/709 |
| 5,404,929 | 4/1995 | Till | 164/66.1 |

OTHER PUBLICATIONS

Gordon Cousins, "Heat–Treatment Company Expands Its Product Range", no date, no other information available.*

ASM Committee on Fabrication of Titanium, "Forming of Titanium Alloys", no date, no other information available.*

L'Air Liquide Concast Conspal, advertisement, Switzerland, 1979, no other information available.*

John R. Paules et al. "Ladle Stirring & Stream Shrouding with Carbon Dioxide at ARMCO's Midwestern Steel Division.", 70th Steelmaking Conference Proceedings, pp. 129–132, Apr. 1987.*

* cited by examiner

APPARATUS AND METHODS FOR GENERATING AN ARTIFICIAL ATMOSPHERE FOR THE HEAT TREATING OF MATERIALS

BACKGROUND OF THE INVENTION

1. Field of the Invention

The present invention relates to the heat treatment of materials in an artificial atmosphere. More specifically, the present invention relates to the heat treatment of metals and alloys in an atmosphere substantially purged of oxygen through the use of a bi-phasic cryogen.

2. Description of the Related Technology

The production of finished metal products is carried out through a series of heat treating processes. Extracted raw metal ores are generally heated in furnaces in which ore reduction and smelting take place. Heating the materials into molten form allows the metal to be separated from impurities and allows the molten metal to be uniformly blended with other materials and metal to form alloys and metals of different grades. Once a desired composition is achieved the molten metal is removed from the furnace and allowed to cool in the form of ingots or slabs.

The ingots and slabs are then processed into the desired product form and shape, i.e., bar, sheet, strip, tube, wire. The typical forming and shaping process is generally carried out in a rolling mill furnace. In a rolling mill, ingots and slabs are heated so as to become more malleable and thereby more easily shaped into the desired product form. The heated ingots and slabs are then rolled, i.e., they are passed between opposed rolls in the cavity of the mill whereby they undergo an increase in length and a reduction in height or depth. Generally, it is not possible to reduce large slabs of metal into desired product form by a single pass through a pair of rolls. The forming process usually requires passing the metal several times through the same pair of rolls, wherein the rolls are progressively brought into abutment and the product is brought into its final shape. Alternatively, metals can be passed through a rolling train, wherein a series of rolls with gaps of diminishing width are provided in a successive relationship that conclude with the product being pressed into its final product shape.

Other forming and shaping processes in the art that generally require the heat treating of materials in furnaces include, but are not limited to, sintering powders, brazing metals and sealing glass to metals. As understood by one of ordinary skill in the art, an oxide layer (i.e. mill scale) is formed on the surface of oxidizable materials, particularly metals and alloys, whenever such a material is heat-treated in the presence of oxygen. This oxide layer must be removed, or preferably prevented from forming, before any successive forming or subsequent processing steps can be performed.

Accordingly, there has been a long-felt, yet unresolved, need in the art of metal fabrication to provide a method and apparatus for heat treating metals and alloys that reduces or prevents the formation of an oxide layer on the treated material's surface. This need is particularly acute in the annealing process, especially in the annealing of exotic metals and alloys. By "exotic," it is meant those comparatively rare specialty metals and alloys that may be particularly susceptible to oxidation, or otherwise have a high affinity for oxygen. Representative exotic metals include, but are by no means limited to, zirconium, titanium, molybdenum, tantalum and columbium.

Annealing is the process through which stresses and distortions in formed metal products are removed. Annealing generally involves the heating of a product to an effective temperature for a period long enough to allow the molecular structure of the material to adjust to a more uniform arrangement, and then controlling the cooling of the material such that the uniform arrangement can be maintained in the final product. Annealing is an important step in the finishing process of metal products. It is through annealing that a uniform and strong product being substantially free of weak spots and distortions is ensured.

Annealing of metal products generally involves several heating and cooling cycles to ensure uniformity of the finished product. As will be appreciated by one of ordinary skill in the art, each such cycle involves passing the metal product through the chamber of a furnace. The presence of oxygen in the furnace results in the formation of an oxide layer on the product's surface with each pass through the furnace. This layer must be removed from the product before the product can be sent through the furnace for the next heating and cooling cycle.

Removal of the oxide layer generally involves submerging the metal product in an acid bath to remove the oxide layer by corrosion. This "pickling" process necessitates the use of large volumes of acids, such as sulfuric acid, nitric acid and hydrofluoric acid. The presence and use of these acids on-site poses significant health, safety and environmental concerns. The acids must be shipped, delivered, stored and used in large quantities. In addition, pollution control and disposal of these acids is also of great concern and a considerable operating expense. Accordingly, there has been a long-felt need in the art to devise a method and apparatus that allows for the reduction or elimination of the need to pickle products during annealing and finishing processes. A similar need exists in other heat treating processes that ultimately result in the need to pickle products before successive or subsequent processing and finishing operations can be undertaken.

Prior art methods have failed to satisfy these long-felt needs. One such method prescribes the use of a completely fluid tight furnace chamber. The furnace chamber is then vacuum evacuated of substantially all ambient oxygen prior to heating the material to be treated. This process requires a special vacuum furnace and is generally only suitable for small batch processes. Further, the furnace must be capable of preventing the leaching of outside ambient air into the process in order to prevent a corrupting of the entire process. The use of a vacuum furnace also results in the need for a substantially long cooling period which lowers plant productivity. In addition, a vacuum process can be prohibitively expensive for many metals. Estimates on the price of operating a vacuum furnace range from $400–$600 per hour. Thus, there remains a need in the art for a less expensive, non-vacuum process that is suitable for large volume, continuous annealing and heat-treating processes.

Another common prior art method involves the purging of ambient oxygen from the furnace chamber by the introduction of an inert gas blanket. This method requires a continuous flow of gas to provide enough gas pressure in the chamber to prevent the ambient, oxygen rich air from reentering the chamber area. Even with a substantially fluid tight chamber, this process requires an extraordinarily large volume of gas to be used during the process and yet still fails to keep the concentration of residual oxygen low enough to prevent the formation of an oxide layer on most metal products. This is particularly true with respect to the easily oxidizable specialty metals, which still must undergo acid pickling despite the use of inert gases. Thus, there still remains a need in the art to achieve low residual oxygen concentrations through a purging process without having to use substantial volumes of inert gases or reach excessive pressures.

SUMMARY OF THE INVENTION

The present invention overcomes the practical problems described above and offers new advantages as well. The present invention is based on the discovery that, quite unexpectedly, the introduction of an inert gas in at least partially liquid form into the heating chamber of a heat treating apparatus produces such an effective blanket purging environment that the residual oxygen concentration, if any, is kept at such a low level that the formation of an oxide layer on a heat treated surface is almost, or completely, non-existent. This is true even when the product being treated is an exotic metal or alloy. Although not wishing to be bound by theory, it is believed that these unexpected results are due to the inherent ability of the transformation of the liquid constituent into gaseous form to achieve high concentrations of the purge gas through volumetric expansion in a desired location; whereas, by contrast, the simple introduction of inert gases, even in large volumes, dissipates before achieving similar concentrations.

Accordingly, one object of the present invention is to provide a heat-treating chamber capable of receiving a gas in at least partially liquified form. It is another object of the invention to provide a heat-treating chamber capable of receiving a gas in at least partially liquified form from a plurality of sources, whereby different gases, or a combination of the same or different gases, can be introduced, simultaneously or at different times, into the same chamber in partially liquified form. It is yet another object of the invention to provide a method of heat-treating a material in a reduced oxygen atmosphere by introducing a purge gas, or purge gases, in at least partially liquified form into the atmosphere of a heat-treating chamber.

In accordance with an object of the invention, there is provided an apparatus for heat-treating a material comprising a furnace having a sidewall defining a chamber and defining a discharge receiving orifice, and a cryogen source having an outlet in fluid communication with the orifice. In accordance with one aspect of the invention, the furnace may include an untreated product inlet for receiving a product to be heat-treated and a treated product outlet for discharging the product after heat-treating. The product inlet and product outlet may be positioned such that the product enters the furnace through the product inlet, passes through the chamber, and then exits the furnace through product outlet.

In accordance with another aspect of the invention, the chamber may be partially or substantially isolated from the ambient atmosphere outside the furnace. The chamber may also include a hot/work zone wherein a heat source heats a product passing therethrough to a desired, elevated temperature, and a cooling zone wherein a product exiting the hot/work zone is cooled prior to exiting the furnace. The heat source may comprise hot gas jets disposed in the hot/work zone or a heat source which provides heat to the hot/work zone by convection or conduction. The cooling zone may have cooling gas jets disposed therein, provide quenching, or comprise an isolated area for natural cooling from heat transfer with the zone's atmosphere.

In accordance with another aspect of the invention, the cryogen source may be a low pressure source comprising an inert gas liquified under pressure. The cryogen source may have an outlet and a regulator coupled thereto. The pressure of the cryogen source may be between about 20 to 40 psig. The cryogen may be liquid nitrogen or liquid argon. The cryogen may enter the furnace in bi-phasic form as a spray heavy with liquid. The bi-phasic ratio of liquid to gas may be any effective ratio. Effective ratios may be between about 30/70 liquid to gas to about 90/10 liquid to gas. The ratio may depend on the product being treated and the specific heat-treating process being undertaken.

In accordance with yet another aspect of the invention, there is provided a conduit for providing fluid communication from the cryogen outlet to the discharge receiving orifice. The conduit may be constructed of any material capable of accepting and discharging the cryogen flow. The conduit may comprise 304 grade stainless steel or like materials that can withstand the operating temperatures, pressures and flow rates of the present invention. The conduit may further include a discharge tip. The discharge tip may simply comprise the discharge end of the conduit being tapered or crimped into a slot or other geometric shape which is capable of ensuring a substantially uniform flow of the bi-phasic cryogen into the furnace. Alternatively, the conduit may be fitted with a specialized nozzle which ensures a substantially uniform flow. The conduit and the orifice may be sealed in fluid tight communication or of an integral construction.

According to a further aspect of the invention, there is provided a fluid control means for controlling the flow of cryogen exiting the cryogen source and entering the furnace. The fluid control means may comprise a pump. The pump may be of the venturi-type. The fluid control means may be capable of adjusting the cryogen flow whereby a desired flow rate and/or gas concentration can be regulated.

In accordance with another object of the invention, there is disclosed a method of heat-treating a material in a reduced oxygen atmosphere by the introduction of a bi-phasic cryogen to create a substantially oxygen free atmosphere in a heat-treating chamber.

These and other objects, aspects, features and advantages of the present invention will be apparent from the following description of the invention with reference to the accompanying drawings.

DETAILED DESCRIPTION OF THE PREFERRED EMBODIMENTS

The present invention may be carried out in a wide variety of heat treating furnaces for a wide variety of heat treating applications. As will become apparent to one of ordinary skill in the art, the term "furnace" as used herein, is meant to include any non-vacuum apparatus that provides a partially or substantially isolated chamber capable of receiving heat from a heat source, whereby materials passing therethrough may be heat treated therein. Representative furnaces that may be suitable for use with the present invention include, but are not limited to, rolling mills and annealing furnaces; such as, the "continuous type," manufactured by many different commercial vendors for the heat treating of titanium strip, and the "batch type," manufactured by Lindberg for the annealing of nickel-based alloys. Preferred furnaces according to the present invention have a chamber, of any geometrical shape, that is sufficiently isolated from the ambient atmosphere outside the furnace such that an artificial atmosphere within the chamber can be produced, maintained, and manipulated as described herein.

Figure 1:
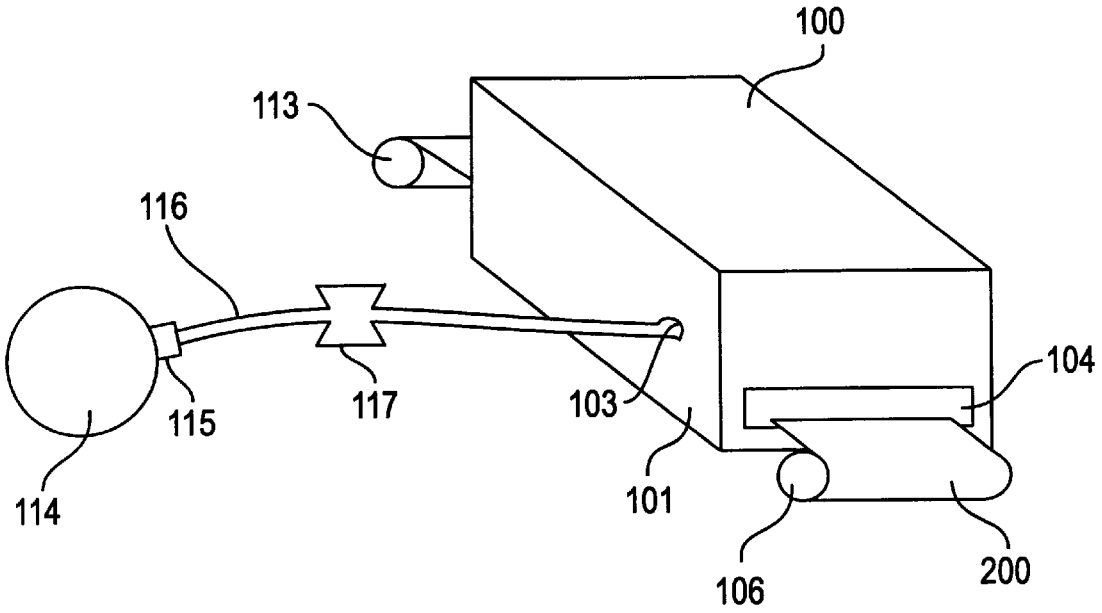
FIG. 1 is a perspective view of a preferred embodiment of the present invention.
Figure 2:
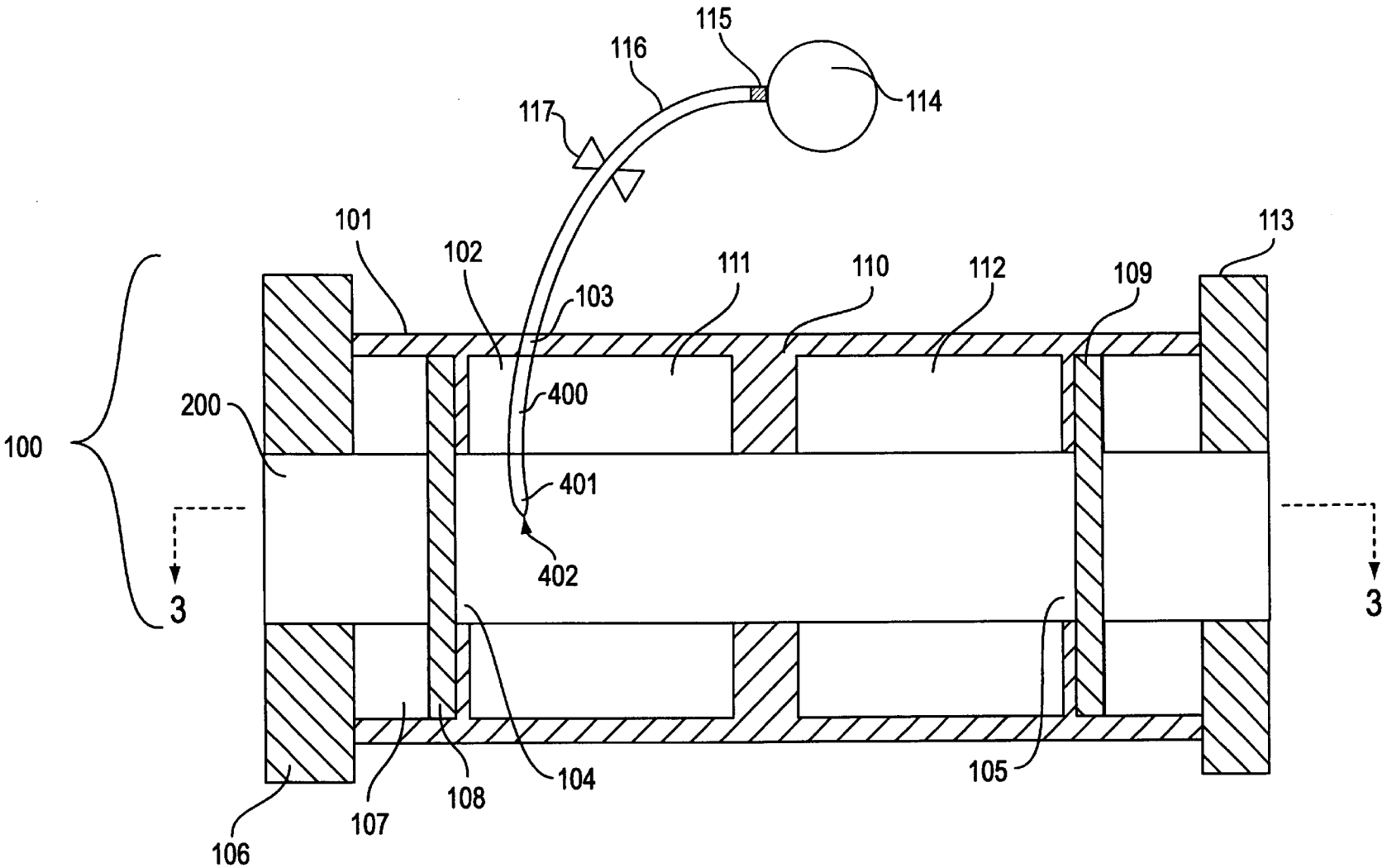
FIG. 2 is a cross-sectional view of a preferred embodiment of the present invention.
Figure 3:
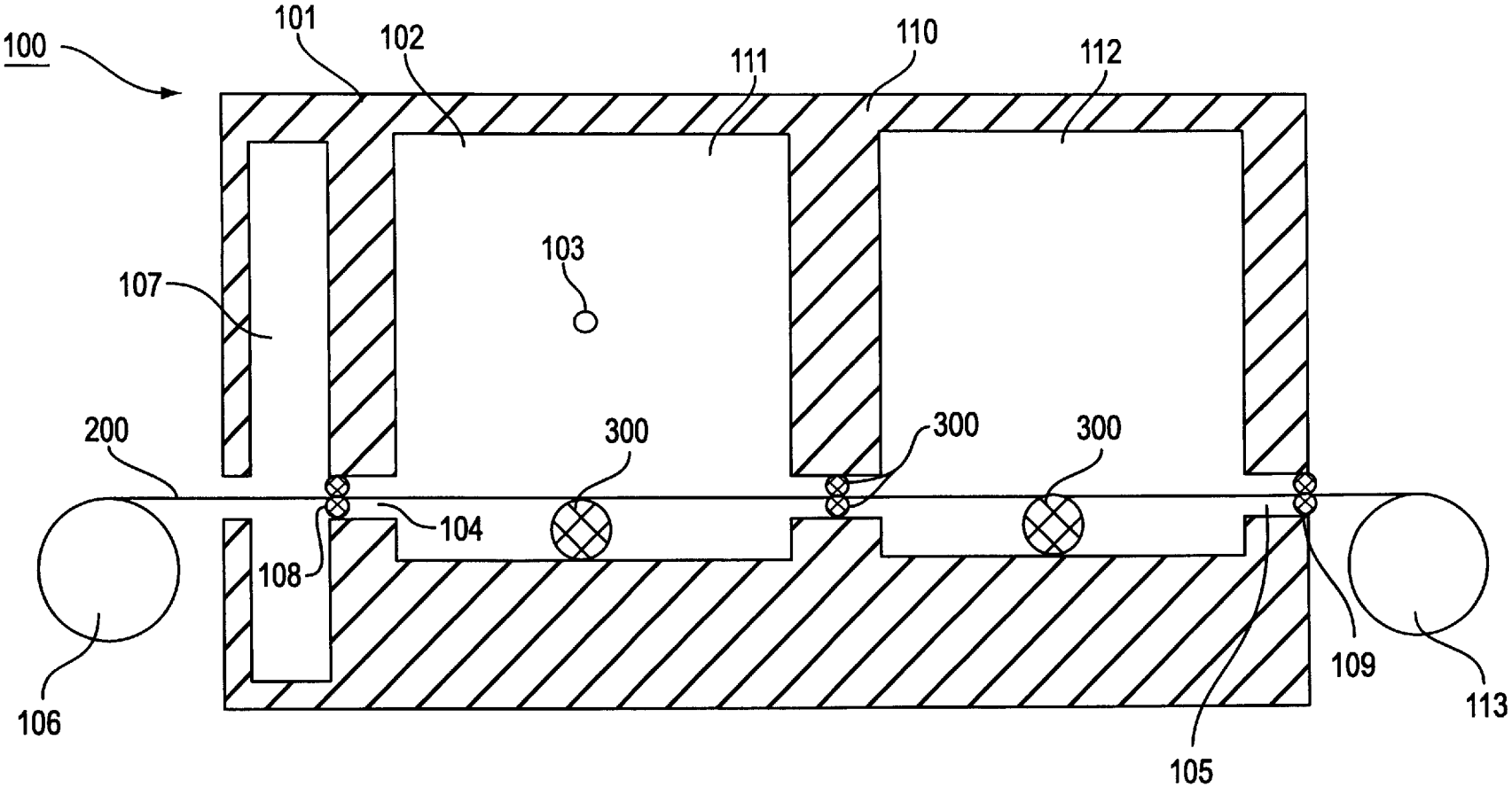
FIG. 3 is a cross-sectional view of the embodiment depicted in FIG. 2 taken along line 3—3.

FIGS. 1–3 depict the present invention as it might be embodied in a conventional furnace for the continuous annealing of metal strip rolls. As best shown on FIGS. 2 and 3, the furnace 100 of this embodiment comprises a sidewall 101 defining a chamber 102 and also defining a discharge receiving orifice 103. The furnace 100 may further comprise an untreated product inlet 104 and a treated product outlet 105, said inlet 104 and outlet 105 being disposed on adjacent ends of the furnace 100, whereby a product being treated must enter the furnace 100 from the untreated product inlet 104, pass through the chamber 102, and exit the furnace 100 through the treated product outlet 105.

Typically, the furnace 100 will be constructed such that a strip roll 200 is unrolled from a payoff reel 106 and introduced into the furnace via a cleaning tank and/or burn-off chamber 107 which removes rolling oils in order to ensure only clean strip enters the furnace 100. The cleansed strip 200 then enters the furnace 100 via a pair of vertically adjacent entry seal rolls 108 disposed adjacent to the untreated product inlet 104 of the chamber 102. The entry seal rolls 108 may serve to ensure the untreated product inlet 104 is at least partially fluid tight, thereby isolating the chamber atmosphere from the ambient atmosphere.

As best shown in FIG. 3, the furnace 100 is provided with a plurality of rolls 300, which serve to guide the strip 200 from the untreated product inlet 104, through the length of the chamber 102, to the treated product delivery outlet 105. As with the untreated product inlet 104, the treated product outlet 105 of the furnace 100 may also be made at least partially fluid tight by the provision of exit seal rolls 109 disposed adjacent to the outlet 105, thereby aiding the maintenance of a controlled environment inside the furnace chamber 102. Treated strip 200 exiting the furnace may be collected on a take-up reel 113. In prior art processes, the collected product conventionally required pickling to remove any oxide layer or product staining prior to further treatment or finishing (i.e. metal plating or additional roll-reduction) or subsequent passes through the annealing furnace. The present invention obviates this need.

The furnace chamber 102 may be divided by at least one partition 110 which serves to separate the chamber 102 into at least one hot/work zone 111 and at least one cooling zone 112. The hot/work zone 111 and cooling zone 111 are kept in communication by a tunnel passing through the partition 109, whereby strip 200 can be transported between the various zones. The partition 109 may also serve to help keep the environments of the separate zones of the chamber substantially isolated from each other by means of abutting rolls 300 disposed in the tunnel of the partition 110.

In the hot/work zone 111 of the chamber 102, the strip 200 is typically heated by radiant energy from radiant tubes or heating elements (not shown). However, any effective heat source may be suitable for use with the present invention. The heating temperatures and heating rates in the hot/work zone 111 are capable of being controlled by methods generally understood in the art, and the specific temperatures and rates are dependent upon the material being treated and the mechanical properties desired for the end product. After sufficient heating, the strip 200 then passes through the tunnel of partition 110 into the cooling zone 112, in which, the strip 200 may be slow cooled or fast cooled at a controlled rate prior to exiting the furnace 100. The temperatures, gas pressures, and product retention times in each zone of the chamber 102 are closely monitored and controlled manually or automatically by methods generally known in the art to ensure the success of the annealing process.

The entire annealing process taking place inside the furnace 100 is typically carried out in a controlled atmosphere. Generally, the atmosphere sought is one artificially purged of a substantial portion of ambient oxygen in order to reduce the amount of oxidation that occurs on the treated material's surface. Prior art methods disclose the introduction of an inert gas into the chamber to blanket, or purge, the process area, thereby creating an artificial atmosphere.

According to the present invention, the artificial atmosphere is created by the use of a purge gas in at least partially liquified form. A purge source for use in the present invention may be a cryogen source 114. Preferably, the cryogen source 114 is of the low pressure-type, meaning a source having a tank pressure of about 20 psig to about 40 psig. Preferred cryogens for use in the present invention are those of the inert gases, which are capable of reducing the oxygen concentration in the chamber 102 and providing an effective atmosphere for heat treating processes. Presently preferred cryogens include liquid nitrogen and argon. Nitrogen is presently preferred for use with non-ferrous metals and alloys, such as copper and aluminum, due to the relative inexpense of liquid nitrogen. Argon is presently preferred for materials having a relatively high affinity for oxygen, such as exotic metals and alloys (i.e. titanium, molybdenum).

The use of cryogens in the purging process has proven to be unexpectedly superior to the prior art gas-only methods for purging heat treating chambers. Gas only processes were only capable of reducing the oxidation of products being treated, but were unable to completely prevent the staining of heat treated products due to oxidation from residual oxygen in the chamber environment. Although not wishing to be bound by theory, it is believed that the unexpected results flowing from the use of cryogens is due to their inherent ability to overwhelm a confined area through their enormous volumetric expansion upon transformation from liquids into gases, thereby being capable of concentrating in significant levels in the chamber environment. By contrast, gas-only methods tend to result in the dissipation of the purge gas without significant concentrations being realized. For example, argon undergoes an 840-fold increase upon evaporation and nitrogen undergoes a 695-fold expansion. The amount of gas required to achieve even a partial level of concentration comparable to that of an evaporating cryogen is on the order of magnitude of five times that of the cryogen volume introduced. One of ordinary skill in the art will also understand that less source material is needed if a cryogen is used as a purge source instead of a gas, which leads to cost savings on process inputs.

The delivery system of the cryogen into the process is best depicted in FIGS. 1 and 2. As shown in FIGS. 1 and 2, the sidewall 101 of the furnace 100 may have a discharge receiving orifice 103 for accepting a purge fluid into the chamber 102. The orifice 103 may be an existing orifice in a conventional furnace, wherein a purge gas from a purge-gas source was introduced; or alternatively, the orifice 103 may be created in the sidewall 101 of the furnace 100 for the specific purpose of accepting a cryogen into the process. The sidewall 101 of the furnace 100 may have a plurality of discharge receiving orifices. For example, orifices may be positioned such that a cryogen may be introduced into the hot/work zone, cooling zone (i.e. for fast cooling via a cryogen input), or both. Similarly, orifices may be provided near the product inlet 104, product outlet 105, or both. In addition, orifices may be positioned, such as on adjacent sides of one or more zones within the chamber 102, so as to allow a plurality of the same or different cryogen sources 114 to be kept in communication with the same or different areas of the chamber 102. Accordingly, one of ordinary skill in the art will recognize that any number of orifices may be positioned in any number of places and be kept in communication with any combination of cryogenic and/or non-cryogenic sources desired for practicing the present invention. In a preferred embodiment, the discharge receiving orifice 103 is positioned within the sidewall 101 of the furnace 100 at a location approximately 10 to 24 inches above the work/hot zone 111 of the chamber 102.

With reference to the delivery system depicted in FIGS. 1 and 2, there is disposed within the orifice 103, or coupled thereto, a conduit 116 having a discharge tip 400 coupled thereto, or integral therewith, for discharging a cryogen into the chamber 102. The conduit 116 carries a cryogen from the cryogen source 114 via the cryogen outlet 115 to the discharge tip 400. The cryogen outlet 115 may have a regulator disposed thereon to aid the delivery and flow of cryogen from the cryogen source 114. In addition, disposed along the path of the conduit 116 in a position between the cryogen outlet 115 and the discharge tip 400 may be a pumping means 117 for controlling the flow of cryogen through the conduit 116. The necessity and type of pumping means will depend on the length of the conduit 116 from the cryogen source 114 to the furnace 100 and on the type and material of the conduit 116 used. A presently preferred pumping means 117 is that of the venturi-type, which has proven effective for the delivery of cryogens. However, one of ordinary skill in the art will appreciate that any pumping or delivery means effective for the control of cryogen flow is within the scope of the invention.

Similarly, one of ordinary skill in the art will appreciate that a conduit 116 for use in the present invention may be of any design and material capable of withstanding the process temperatures, pressures and flow rates posed by the specific use being undertaken. The conduit 116 is preferably suitable for coupling to the outlet 115, or a regulator attached thereto, of the cryogen source 114. The conduit 116 is also preferably capable of coupling to, or fitting integrally with, the discharge receiving orifice 103. A presently preferred conduit 116 comprises type 304 stainless steel, or like material.

Figure 4A:
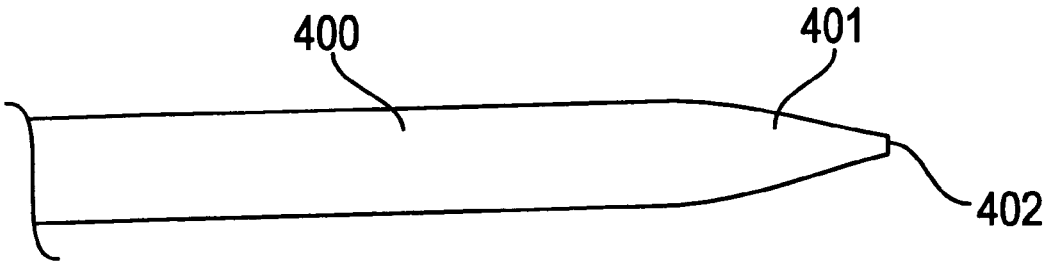
FIG. 4A is a cross-sectional view of a an embodiment of a fluid tip according to the present invention.
Figure 4B:
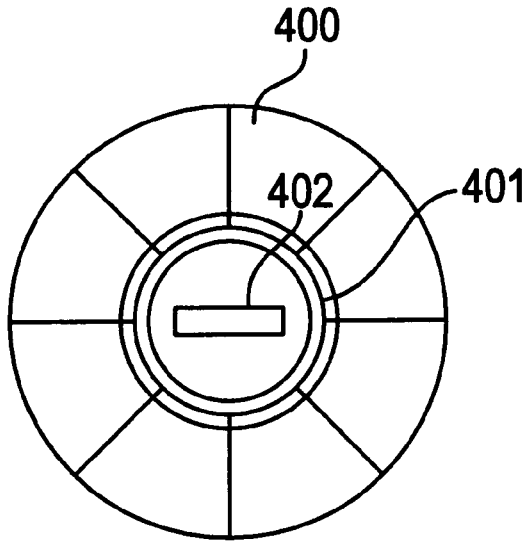
FIG. 4B is a front plan view of the fluid tip of FIG. 4A.

An exemplary discharge tip 400 is depicted in FIGS. 4A and 4B. The delivery tip 400 may comprise a head portion 401 which is tapered or crimped to define a slot-shaped discharge opening 402. Any suitable tip 400 may be used in the present invention. The tip 400 may be a nozzle type attachment coupled to the conduit 116, or alternatively, a nozzle-type attachment being integral therewith. As depicted in FIGS. 4A and 4B, a suitable tip 400 may be provided by simply crimping the conduit 116 such that the discharge opening 402 is more narrow than the conduit's diameter. It is preferred that the discharge opening 402, and even more preferably, also the head portion 401 leading thereto, be more narrow than the conduit diameter in that this configuration helps to ensure a continuous controlled discharge from the opening 402 which is substantially free of flow-gaps or flow-surges. Accordingly, one of ordinary skill in the art will understand that a delivery tip 400 for use with the present invention may be of almost any configuration which serves to aid the continuous, regulated, and uninterrupted flow of the cryogen into the chamber 102.

The cryogen delivered into the chamber 102 is preferably in a bi-phasic form (admixture of liquid and gas). As will be appreciated by one of ordinary skill in the art, a cryogen in bi-phasic form is more easily delivered into a process and more easily regulated to ensure constant flow rate and uniform discharge. Preferred for use in the present invention are cryogens having a bi-phasic ratio of between about 30/70 liquid to gas and 90/10 liquid to gas; with a preferred ratio being about 70/30 liquid to gas. In bi-phasic form, the cryogen may exit the discharge opening as a spray heavy with liquid. As will be appreciated by one of ordinary skill in the art, a discharge of a spray heavy with liquid typically displays a continuous and uniform discharge which is substantially free of gaps and surges, and is also typically easy to monitor and manipulate to ensure a desired and controlled flow rate.

In operation, the furnace 100 may be prepared to accept strip 200 from the payoff reel 106 located adjacent the untreated product inlet 104. The cryogen source 114 is then activated and cryogen exits the source 114 at a controlled rate via the regulator positioned on the outlet 115. The cryogen enters the conduit 116, which extends through the discharge receiving orifice 103 disposed in the sidewall 101 of the furnace 100, and is directed by the pumping means 117 to the delivery tip 400 of the conduit 116. The cryogen then exits the tapered head portion 401 of the tip 400 via the discharge opening 402 and enters the hot/work zone 111 of the chamber 102 as a spray heavy with liquid. Heat is then supplied to the hot/work zone 111 until a suitable annealing temperature for the strip 200 is reached. The pressure and temperature of the hot/work zone 111 are monitored and may be adjusted by any means, such as adjusting the cryogen flow rate or adjusting the amount of heat supplied to the hot/work zone 111, in order to ensure the chamber 102 remains substantially purged of oxygen. The strip 200 is then unrolled from the payoff reel 106 and passed through the cleaning tank/burn-off chamber 107 and enters the untreated product inlet 104 after passing through the entry seal rolls 108. The strip 200 is retained for a designated period of time in the hot/work zone 111 prior to being passed through the tunnel of the partition 110 into the cooling zone 112 via a plurality of rolls 300 disposed throughout the chamber 102. After cooling, the strip 200 is then sent through the exit seal rolls 109 and collected on the take-up reel 113. The strip 200 may then be further processed, however, the need to pickle the strip 200 before further processing should be obviated.

EXAMPLE 1

A conventional 500 cubic foot conventional gas-only annealing furnace of the continuous type was adapted for use with the present invention. This furnace had previously only been achieving a nominal 25–30 ppm residual oxygen level in furnace runs through the use of nitrogen, gaseous argon. This atmosphere resulted in each annealing run taking between 3 to 7 hours and still resulted in significant staining of many metals which required acid pickling to be undertaken after each annealing cycle.

The experiment was conducted on 800 feet of a 0.100 inch thick, 25 inch wide strip of unalloyed zirconium. The furnace was prepared in less than 30 minutes to be capable of receiving liquid bi-phasic argon.

The cryogen source used in the experiment was a 180 liter Dewars of liquified argon stored at a tank pressure of 22 psig. A grade 304 stainless steel conduit was connected on a first end to the regulator of the tank outlet and crimped on the opposite end to form a tapered delivery tip having a slot shaped delivery opening. The delivery tip was positioned in the chamber located at a position center to, and about 15 inches above, the product path in the hot/work zone.

The argon was delivered to the chamber in an approximately 70/30 liquid to gas bi-phasic form and delivered through the delivery tip as a spray heavy with liquid. About 1.9 to 3.0 lb./min. of bi-phasic argon were introduced into the hot/work zone, resulting in a nominal furnace chamber pressure of about 0.8 psig and a residual furnace oxygen concentration of about 10 ppm after 19 minutes. Adjustments of the bi-phasic argon showed that chamber atmospheres could be easily reached having residual oxygen levels of about 6 ppm.

The temperature of the hot/work zone was then adjusted from a starting temperature of about 400° F. to an operating temperature of about 1600° F. through the use of electric heating elements. The temperature increase showed that an argon transition-to-pressure relationship existed. The bi-phasic argon flow was adjusted several times in order to quantify suitable operating parameters and in order to stabilize the pressure over the hot/work zone. These adjustments were successful in keeping residual oxygen levels between about 5.8–10 ppm without having to exceed argon chamber pressures of 1.9 psig.

The entire load of strip was passed through the furnace and collected in about seven hours with a hot/work zone temperature of about 1600° F. The hot/work zone throughout the annealing run was maintained at argon pressures between 0.2–1.4 psig and residual oxygen levels of a nominal 5.4–11 ppm.

After completion of the annealing run, the product was inspected and unexpectedly displayed no evidence of staining or oxidation which completely negated the need for acid pickling. The complete absence of staining is indicative of the potentially broad applicability of the present invention for providing cheap and effective heat treating atmospheres for most materials in most non-vacuum furnaces.

The experiment clearly showed that the relationship between bi-phasic flow and chamber pressure allows residual oxygen levels of 5.8–7.2 ppm to be reached and maintained with an internal furnace pressure of only 0.4–1.4 psig while operating at temperatures exceeding 1600° F. A residual oxygen level of about 7 ppm appears to be suitable to prevent any oxidation or staining of high oxygen-affinity metals during the annealing process (other trials were performed with CP titanium).

EXAMPLE 2

The furnace of Example 1 was again prepared to run 1200 feet of 0.100 inch thick, 25 inch wide titanium strip in a bi-phasic argon protective atmosphere. As with Example 1, the argon source was a 180 liter Dewars at a pressure of 22 psig. In this experiment, approximately 2.8 lb./min. of argon in a 70/30 bi-phasic form was introduced into the chamber. The chamber pressure increased to 2.1 psig and the residual oxygen concentration fell to about 9 ppm in about 9 min. The chamber was then heated to a temperature of 1600° F. and the argon flow rate was adjusted as the furnace chamber temperature increased, resulting in pressure variations of 0.3–0.7 psig and residual oxygen concentrations of 5.4–10 ppm.

The titanium strip was fed through the furnace and sustained in the hot/work zone for a nominal minute at a temperature of about 1600–1650° F. The argon flow rate was adjusted to provide a desired chamber residual oxygen level of 7.2 ppm. The strip was then held in the cooling zone for about 5 min.

After completion of the annealing run, the product showed no signs of oxidation or staining despite titanium's high oxygen affinity, confirming the unexpected results of Example 1. This experiment indicated that atmospheres with levels below 10 ppm of residual oxygen should prevent any staining or oxidation during the annealing process.

During the course of these experiments, the bi-phasic flow rate was adjusted to determine preferred protective atmosphere parameters for the furnace. The lowest level of residual oxygen achieved during the trial was 5.4 ppm at a partial pressure of transformed argon of 3.1 psig. The 3.1 psig pressure of argon in the hot/work zone resulted in the oxygen depletion alarms on both exterior ends of the furnace to sound. For operator safety, a preferred set of operating parameters were determined for this semi-sealed furnace and heat treating application. Test results indicated that the preferred oxygen/pressure relationship for the furnace in this application was maintaining a nominal 7.2 ppm oxygen level at a pressure of about 0.3 to about 1.4 psig partial pressure of transformed argon. Accordingly, one of ordinary skill in the art will understand that these operating parameters will depend on the furnace used and heat treating application being undertaken.

A summary of the results of the Examples is set forth in Table 1.

TABLE 1

| | Example 1 | Example 2 |
|---|---|---|
| Strip Type | unalloyed zirconium | commercially pure (CP) titanium |
| Strip Thickness | nominal .110 inches | nominal .100 inches |
| Strip Width | 24 inches | 25 inches |
| Furnace Temperature | 1600° F. | 1650° F. |
| Chamber Volume | 500 cu ft. | 500 cu ft. |
| Cryogen | bi-phasic argon | bi-phasic argon |
| Bi-phasic Ratio | 70/30 liq.-gas | 70/30 liq.-gas |
| Feed Location | Fwd. ¼ of chamber | Fwd. ¼ of chamber |
| Chamber Pressure | nom. 1.8 psig | nom. 0.8 psig |
| Residual Oz (ppm) | nom. 9.1 psig | nom. 7.2 psig |
| Strip Feed Rate | nom. 6 ft./min. | nom. 4 ft./min |
| Retention Time | 180 min. | 420 min. |

The invention disclosed herein is not considered to be limited to the preferred embodiments and examples provided. It is contemplated that any method and apparatus for generating an artificial atmosphere for the heat treating of materials through the use of a bi-phasic cryogen is within the scope of the invention.

I claim:

1. A method of generating a controlled atmosphere inside a furnace having a substantially isolated chamber for heat treating materials comprising:

introducing a cryogen from a cryogen source into said chamber in order to permit the volumetric expansion of said cryogen into gaseous form to substantially purge said chamber, wherein said cryogen is introduced in bi-phasic form, supplying heat to said chamber to reach a temperature capable of heat treating a material introduced into said chamber; and setting and adjusting the cryogen introduction and heat supply to control the temperature and gas concentration inside the chamber at desired levels.

2. The method of claim 1, wherein the bi-phasic ratio of said cryogen is between about 30/70 liquid to gas and about 90/10 liquid to gas.

3. The method of claim 1, wherein the bi-phasic ratio of said cryogen is about 70/30 liquid to gas.

4. The method of claim 1, wherein said cryogen source is an inert gas under pressure.

5. The method of claim 4, wherein said inert gas is nitrogen or argon.

6. The method of claim 4, wherein said cryogen source pressure is between about 20 psig and about 40 psig.

7. A method of annealing a material in a furnace having a substantially isolated chamber having a hot/work zone and a cooling zone, comprising:

introducing a bi-phasic cryogen into the hot/work zone of said chamber in order to allow the volumetric expansion of said cryogen to substantially purge oxygen from said hot/work zone, supplying a quantity of heat to said hot/work zone sufficient to raise the temperature within said hot/work zone to a temperature capable of annealing said material, passing said material through the hot/work zone and the cooling zone for a period of time sufficient to anneal said material, and monitoring and adjusting the introduction of cryogen and the supply of heat throughout the annealing process to ensure the effective annealing of said material.

8. The method of claim 7, wherein the bi-phasic ratio of said cryogen is between about 30/70 liquid to gas to about 90/10 liquid to gas.

9. The method of claim 7, wherein the bi-phasic ratio of said cryogen is 70/30 liquid to gas.

10. The method of claim 7, wherein the cryogen comprises nitrogen or argon.

11. The method of claim 7, wherein said material comprises metal.

12. The method of claim 7, wherein said material is a metal or alloy.

13. The method of claim 7, wherein said material is an exotic metal or alloy.

14. The method of claim 13, wherein said exotic metal or alloy is selected from the group consisting of zirconium, titanium, molybdenum, tantalum and columbium.

15. The method of claim 7, wherein said material is a metal or alloy in the shape of bar, sheet, strip, tube or wire.

16. The method of claim 7, wherein said cryogen is introduced into said hot/work zone via a plurality of discharge receiving orifices disposed in said hot/work zone.

17. The method of claim 1, wherein said furnace is adapted for annealing metals and alloys.

18. A method of annealing a material in a controlled atmosphere comprising:

introducing a bi-phasic cryogen into a furnace having a sidewall, said sidewall having a discharge receiving orifice, supplying heat to said furnace to reach a temperature capable of annealing a material introduced into said chamber, and passing said material through said furnace.

19. The method of claim 18, wherein said cryogen comprises nitrogen or argon.

20. The method of claim 19, wherein said material is an exotic metal or alloy.

* * * * *